United States Patent [19]

Mandel et al.

[11] 4,387,357

[45] Jun. 7, 1983

[54] ROTARY ACTIVATOR

[75] Inventors: Sheldon W. Mandel, Galesburg; Kenneth E. Davis, Chicago, both of Ill.

[73] Assignee: Magic Chef, Inc., Cleveland, Tenn.

[21] Appl. No.: 252,888

[22] Filed: Apr. 10, 1981

[51] Int. Cl.[3] ..... H01F 7/08; H01F 7/14; H01H 51/22

[52] U.S. Cl. ..... 335/272; 335/79; 335/230

[58] Field of Search ..... 335/272, 229, 230, 78, 335/79, 80, 81; 340/815.24, 815.26; 324/146

[56] References Cited

U.S. PATENT DOCUMENTS

| | | | |
|---|---|---|---|
| 3,300,776 | 1/1967 | Fitch et al. | 340/815.26 |
| 3,309,696 | 3/1967 | Alster et al. | 340/815.24 |
| 3,343,451 | 9/1967 | Durocher | 350/486 |
| 3,422,426 | 1/1969 | Bailey et al. | 340/815.24 |
| 3,553,619 | 1/1971 | Skrobisch | 335/272 |
| 3,573,811 | 4/1971 | Knecht | 340/815.24 |
| 4,302,720 | 11/1981 | Brill | 324/146 |

*Primary Examiner*—Harold Broome
*Attorney, Agent, or Firm*—Bacon & Thomas

[57] ABSTRACT

A magnetic rotary activator has a permanent magnet mounted for rotation about a fixed axis and a core member having an energizing coil with a current reversing mechanism. The core member has at least three poles arranged to be reversed in polarity by reversing current flow through the coil. The poles are arranged to rotate the permanent magnet through a predetermined angle upon reversal of current flow.

4 Claims, 3 Drawing Figures

ROTARY ACTIVATOR

BACKGROUND OF THE INVENTION

This invention relates to magnetically operated devices.

It has been known previously to control or activate rotary devices by means of magnetic fields but there is need for a simple structural device capable of easy manipulation to rotate a shaft through a predetermined and fixed angle. Examples of the prior art referred to above are the Hubbard U.S. Pat. No. 2,327,792, Wantosch U.S. Pat. No. 2,892,055 and Ray U.S. Pat. No. 3,694,782.

SUMMARY OF THE INVENTION

The present invention is a rather simple device having a coil wound on a leg of a core member and means for reversing the direction of flow of electrical current through the coil. The core has a plurality of poles so arranged that upon reversal of current flow through the coil different magnetic fields are established between pairs of poles, the different fields being angularly related to each other. A permanent magnet is rotatably mounted for movement into alignment with one or the other of said fields depending upon the direction of current flow in the coil.

In a first embodiment of the invention, the coil is wound on a base leg of a core member, the ends of which are divided into a pair of poles each. The four poles are arranged to define a generally rectangular array and a permanent magnet is mounted for rotation about an axis perpendicular to that array whereby current in one direction through the core establishes a magnetic field with opposite poles diagonally across the rectangular array and with which the permanent magnet may align itself. Upon reversing the current flow, the polarity is reversed and the magnet then rotates to align itself with a different field extending across the other diagonal of the rectangular array. The angle thorugh which the magnet rotates is fixed and predetermined and the magnetic field holds the magnet and any member rotated thereby in fixed position without the use of any detents mechanically engaging any of the movable parts.

A second embodiment of the invention employs a core member of generally E-shape with the coil wound on the central leg of the core and with the end legs being longer than the central leg. A permanent magnet is mounted for rotation about an axis perpendicular to the plane defined by the ends of the three legs or poles and the magnet is arranged to swing to a position where its ends are adjacent the center and one or the other of the end poles. Thus, reversing the direction of current flow through the coil will reverse the polarity of the end poles and the center pole and thus cause the magnet to move into position to be held by the magnetic flux extending from the central pole to one or the other of the end poles and the magnet will be held in that position without the use of mechanical detents or the like.

DESCRIPTION OF THE PREFERRED EMBODIMENTS

Figure 1:
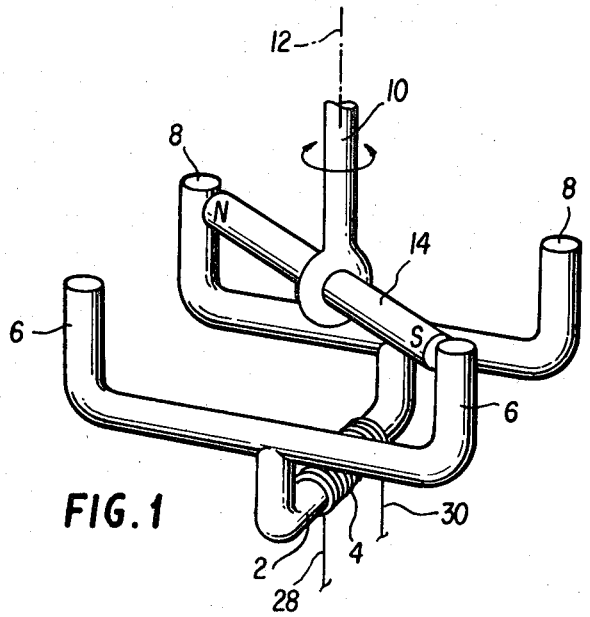
FIG. 1 is a perspective view of a first embodiment of the present invention.

In FIG. 1, a central or base leg 2 of a core member, formed of soft iron or the like magnetic material, is surrounded by a coil 4 wound thereon. The ends of the base leg 2 are bent upwardly and then divided to define a pair of spaced poles 6 which will always be of the same polarity. The other end of the leg 2 is also divided as is the leg just described and defines a pair of poles 8 which likewise are always of the same polarity. It is to be noted that the poles 6 and 8 define a generally rectangular array of poles, two of which will always be of the same polarity and the other two being of the opposite polarity, depending on the direction of current flow through coil 4. A shaft element 10 is suitably journalled by means not shown for rotation about an axis 12 substantially perpendicular to the rectangular array of poles previously described. A permanent magnet 14 is carried by the shaft 10 with its ends on opposite sides of the axis 12 and is of such length that it will substantially span the diagonals of the rectangular array. As shown, one end of the magnet 14 is adjacent a pole 8 while the other end of the magnet is adjacent a diagonally opposite pole 6. It is to be understood that the permanent magnet 14 has poles of opposite polarity at its ends, for example, a north and a south pole as indicated in the drawings.

When the current flow through core 4 is in such direction that the pole 6 adjacent the end of magnet 14 is a north pole, it will attract and hold the south pole of magnet 14 while the diagonally opposite pole 8 attracts and holds the north pole of the magnet 14, since that pole 8 is of negative polarity, or is a south pole. Upon reversing the direction of flow of current through the coil 4, by means to be described, the polarity of the poles 6 is reversed as is the polarity of the poles 8 and the pole 8 adjacent the end of the magnet then repels that magnet while the pole 6 directly opposite the same will attract that end of the magnet and the same action takes place at the other end of the magnet so that the shaft 10 is caused to rotate through such angle that the magnet 14 then becomes aligned with the field extending between the left hand pole 6 and the right hand pole 8. Clearly, the permanent magnet will be held in that position without the use of mechanical detents.

Figure 2:
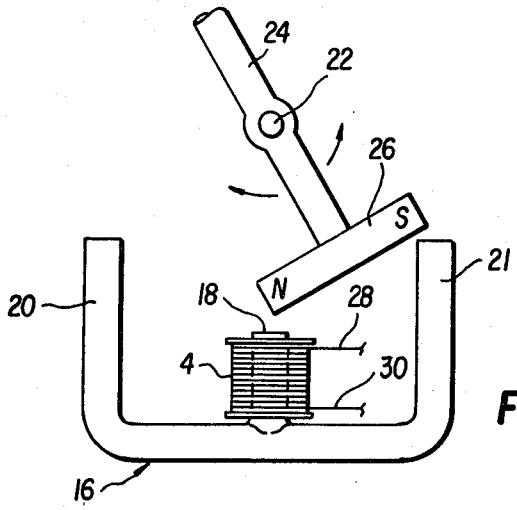
FIG. 2 is a side view of a second embodiment of the invention.

Referring now to FIG. 2, the core member 16 is of generally E-shape and the coil 4 is wound about the central short leg or pole 18 of the core member. End legs or poles 20 and 21 extend generally parallel to the central pole 18 but are longer than that pole and the ends of the three poles thus establish an arc having a central axis 22 about which an arm 24 is rotatable and an end of which carries a permanent magnet 26 extending transversely of the arm 24 and offset from the axis 22. The magnet 26 is of such length that it will substantially span the distance from the central pole 18 to either of the end poles 20 or 21. Thus, when the current is flowing in one direction through the coil 4, a magnetic field is established that holds the permanent magnet 26 in the position shown in FIG. 2, whereas a reversal of the direction of current flow through the coil will cause the magnet to swing to the left to position its ends adjacent the poles 18 and 20 since the direction of the field will have been reversed and thus, the arm 24 is caused to swing through a predetermined angle and is held at the end of its swing without the use of mechanical detents.

Figure 3:
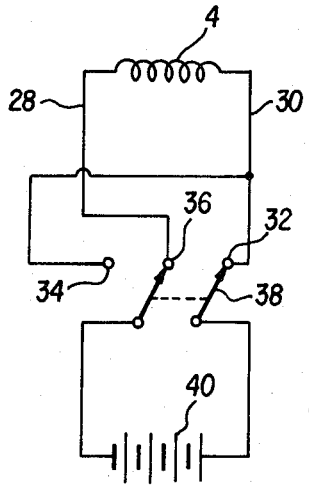
FIG. 3 is a circuit diagram illustrating a suitable control device for the coils of the embodiment of FIGS. 1 and 2.

FIG. 3 illustrates a circuit arrangement capable of reversing the direction of current flow through the coil 4, which may be the coil of either FIG. 1 or FIG. 2. End lead 30 from the coil 4 is connected to a first fixed contact 32 and also to a fixed contact 34 while the lead 28 is connected to a fixed contact 36 between contacts 32 and 34. A gang switch 38 is between contacts 32 and 34. A gang switch 38 is arranged to selectively contact either the terminals 32 and 36 or 34 and 36 to thereby reverse the direction of current flow from battery 40 through the coil 4 and thus reverse the magnetic field controlling the position of the permanent magnet 14 or 26. Obviously, the gang switch 38 may be operated by any desired means, even manually, and it is contemplated that it may respond to some control instrumentality.

While a limited number of specific embodiments of the invention have been shown and described herein, the same are merely illustrative of the principles involved and other forms may be employed within the scope of the appended claims.

What we claim is:

1. A magnetic rotary activator comprising:

(a) a core member;

(b) a coil wound around the core member;

(c) means for selectively directing an electric current flow in either direction through the coil;

(d) the core member including at least three spaced magnetizable pole members whose polarity may be reversed by momentarily reversing the direction of current flow through the coil;

(e) a rotatable permanent magnet disposed between the pole members for rotating into a first position of alignment with one pair of pole members of opposite polarity during one direction of current flow through the coil, and rotating into a second position of alignment with another pair of pole members during flow of current through the coil in the opposite direction, whereby the permanent magnet is caused to be rotated through a predetermined angle; and (f) the pole members being configured to permit the formation of a single magnetic circuit through the permanent magnet and its corresponding pair of pole members in either position of alignment to establish a magnetic detent for maintaining the permanent magnet in either position of alignment upon termination of current flow through the coil.

2. The magnetic rotary activator of claim 1 wherein the core member includes:

(a) a central leg around which the coil is wound and having two ends; and (b) a pair of spaced pole members extending from each end of the central leg.

3. The magnetic rotary activator of claim 2 wherein:

(a) the pole members define a generally rectangular-shaped array; and (b) the permanent magnet is rotatable about an axis disposed between the poles thereof and extending generally perpendicular to and centrally of the array.

4. The magnetic rotary activator of claim 1 wherein:

(a) the core member includes a base leg having two ends;

(b) a short pole member extends laterally from substantially the central portion of the base leg;

(c) the coil is wound around the short pole member;

(d) a long pole member extends laterally from each end of the base leg, with each long pole member being spaced from and disposed parallel to the short pole member;

(e) the permanent magnet is rotatable about an axis laterally offset from the short pole member and extending generally perpendicular to a plane defined by the longitudinal axes of the short and long pole members; and (f) wherein the first and second positions of alignment are defined by the end of the short pole member and the end of either long pole member.

* * * * *

UNITED STATES PATENT OFFICE

CERTIFICATE OF CORRECTION

Patent No. 4,387,357 Dated June 7, 1983

Inventor(s) Sheldon W. Mandel & Kenneth E. Davis

It is certified that error appears in the above-identified patent and that said Letters Patent are hereby corrected as shown below:

In Column 1, line 42, "thorugh" should read --through--.

Signed and Sealed this

*Twentieth* Day of *March 1984*

[SEAL]

*Attest:*

GERALD J. MOSSINGHOFF

*Attesting Officer*

*Commissioner of Patents and Trademarks*